US012031739B2

(12) United States Patent
Kitamura et al.

(10) Patent No.: US 12,031,739 B2
(45) Date of Patent: Jul. 9, 2024

(54) DEVICE MANAGEMENT SYSTEM AND DEVICE MANAGEMENT SERVICE PROVIDING METHOD

(71) Applicant: DAIKIN INDUSTRIES, LTD., Osaka (JP)

(72) Inventors: Takuya Kitamura, Osaka (JP); Kenji Kita, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 364 days.

(21) Appl. No.: 17/437,390

(22) PCT Filed: Mar. 9, 2020

(86) PCT No.: PCT/JP2020/010060

§ 371 (c)(1),
(2) Date: Sep. 8, 2021

(87) PCT Pub. No.: WO2020/189378

PCT Pub. Date: Sep. 24, 2020

(65) Prior Publication Data

US 2022/0178571 A1 Jun. 9, 2022

(30) Foreign Application Priority Data

Mar. 15, 2019 (JP) ..... 2019-048833

(51) Int. Cl.
*F24F 11/61* (2018.01)
*F24F 11/30* (2018.01)
*F24F 11/64* (2018.01)

(52) U.S. Cl.
CPC ..... *F24F 11/61* (2018.01); *F24F 11/30* (2018.01); *F24F 11/64* (2018.01)

(58) Field of Classification Search
CPC ..... F24F 11/61; F24F 11/64; F24F 11/30
(Continued)

(56) References Cited

U.S. PATENT DOCUMENTS 5,822,512 A 10/1998 Goodrum et al.
2005/0141566 A1 6/2005 Krzyzanowski
(Continued)

FOREIGN PATENT DOCUMENTS

JP 10-116206 A 5/1998
JP 2002-514798 A 5/2002
(Continued)

OTHER PUBLICATIONS

European Search Report of corresponding EP Application No. 20 773 136.5 dated May 9, 2022.
(Continued)

*Primary Examiner* — Jigneshkumar C Patel
(74) *Attorney, Agent, or Firm* — GLOBAL IP COUNSELORS, LLP

(57) ABSTRACT

A device management system includes a device installed in a building, a control terminal connected to the device, and a management apparatus connected to the control terminal via a network. Both the control terminal and the management apparatus are configured to be capable of acquiring a control command that is created by a user. The control command that is created by the user is acquired by at least one of the control terminal and the management apparatus. Based on the control command that is acquired, control of the device is shared and executed in at least one of the control terminal and the management apparatus.

18 Claims, 6 Drawing Sheets

(58) Field of Classification Search
USPC ..... 700/276
See application file for complete search history.

(56) References Cited

U.S. PATENT DOCUMENTS

| | | | | |
|---|---|---|---|---|
| 2005/0273508 | A1 | 12/2005 | Humpleman et al. | |
| 2013/0197699 | A1 | 8/2013 | Gyota et al. | |
| 2014/0250183 | A1* | 9/2014 | Unagami | H04M 3/5166 709/204 |
| 2015/0067154 | A1 | 3/2015 | Ly et al. | |
| 2016/0013975 | A1 | 1/2016 | Van Herpen et al. | |
| 2019/0041883 | A1* | 2/2019 | Clark | G05D 23/1934 |
| 2019/0049138 | A1 | 2/2019 | Matsumoto et al. | |
| 2019/0342112 | A1 | 11/2019 | Li et al. | |
| 2020/0232671 | A1 | 7/2020 | Tasaka et al. | |

FOREIGN PATENT DOCUMENTS

| | | | |
|---|---|---|---|
| JP | 2005-130423 | A | 5/2005 |
| JP | 2007-518165 | A | 7/2007 |
| JP | 5465336 | B2 | 1/2014 |
| JP | 2016-515317 | A | 5/2016 |
| JP | 2016-535359 | A | 11/2016 |
| JP | 6160789 | B1 | 6/2017 |
| KR | 20150022256 | A | 3/2015 |
| WO | 2018/133718 | A1 | 7/2018 |
| WO | 2019/013316 | A1 | 1/2019 |

OTHER PUBLICATIONS

International Preliminary Report of corresponding PCT Application No. PCT/JP2020/010060 dated Sep. 30, 2021.
International Search Report of corresponding PCT Application No. PCT/JP2020/010060 dated May 26, 2020.

* cited by examiner

DEVICE MANAGEMENT SYSTEM AND DEVICE MANAGEMENT SERVICE PROVIDING METHOD

CROSS-REFERENCE TO RELATED APPLICATIONS

This U.S. National stage application claims priority under 35 U.S.C. § 119(a) to Japanese Patent Application No. 2019-048833, filed in Japan on Mar. 15, 2019, the entire contents of which are hereby incorporated herein by reference.

BACKGROUND

Field of the Invention

The present disclosure relates to a device management service providing method for managing a device installed in a building by using a network.

Background Information

A system that manages, via a network, air conditioner information of an air conditioner installed in a building has been proposed (for example, Japanese Patent No. 6160789). In Japanese Patent No. 6160789, the air conditioner is connected to an information mediation device, the information mediation device is connected to an information management apparatus via the network, and the information management apparatus manages the air conditioner information.

SUMMARY

A management apparatus connected via a network has many advantages, such as being capable of using management records of devices installed in other buildings or devices of other users and being capable of centralized management of the devices disposed in the other buildings. However, constant control of the devices by the management apparatus via the network may be inefficient in some cases. An extreme case is a case where the network is disconnected, in which case, device control becomes unavailable.

A device management system according to a first aspect includes a device, a control terminal, and a management apparatus. The device is disposed in a building. The control terminal is connected to the device. "Connected to the device" includes a case of being built in and connected to the device. The management apparatus is connected to the control terminal via a network. Both the control terminal and the management apparatus are configured to be capable of acquiring a control command that is created by a user. (a) The control command that is created by the user is acquired by either one or both of the control terminal and the management apparatus. (b) On the basis of the control command that is acquired in (a), control of the device is shared and executed in either one or both of the control terminal and the management apparatus.

In the device management system according to the first aspect, since both the control terminal and the management apparatus can acquire and execute the control command, the user can cause the control command to be shared and executed in either one or both of the control terminal and the management apparatus.

A device management system according to a second aspect is the system according to the first aspect, in which (c) the control terminal and the management apparatus register the control command that is acquired in (a).

A device management system according to a third aspect is the system according to the second aspect, in which the management apparatus (d) determines whether the control command that is acquired in (a) is to be executed in the management apparatus or to be executed in the control terminal. (b1) The control command is executed in the management apparatus if it is determined that the control command is to be executed in the management apparatus in (d). (e) The control command is transmitted to the control terminal if it is determined that the control command is to be executed in the control terminal in (d). (b2) The control terminal executes the control command that is transmitted from the management apparatus in (e).

In the device management system according to the third aspect, since the control command is executed by being allocated to the management apparatus and the control terminal, the control command can be executed efficiently.

A device management system according to a fourth aspect is the system according to the third aspect, including a plurality of devices and a plurality of control terminals. The plurality of devices are installed in a building. The plurality of control terminals are each connected to a corresponding device among the devices. (d1) If it is determined that a device or devices that is/are a target or targets of the control command belongs to a single control terminal among the control terminals in (d), the management apparatus determines that the control command is to be executed in the control terminal, and, if it is determined that the devices that are targets of the control command belong to the plurality of control terminals in (d), the management apparatus determines that the control command is to be executed in the management apparatus.

In the device management system according to the fourth aspect, since the control command related to the single control terminal is to be executed in the control terminal, and the control command related to the plurality of control terminals is to be executed in the management apparatus, the control command can be executed smoothly.

A device management system according to a fifth aspect is the system according to the third or fourth aspect, in which, while the control terminal is executing control of the device on the basis of the control command, if an execution time of the control is longer than a predetermined time, the control terminal cancels execution of the control of the device based on the control command. In addition, the management apparatus executes the control of the device based on the control command.

In the device management system according to the fifth aspect, since the management apparatus executes the control command if the control terminal takes an extremely long time to execute the control command, the time for executing the control command can be shortened.

A device management system according to a sixth aspect is the system according to the fourth aspect, in which (d2) even if the management apparatus determines that the device that is a target of the control command belongs to a single control terminal among the control terminals in the (d1), the management apparatus determines that control based on the control command is to be executed in the management apparatus if execution of the control based on the control command in the control terminal is estimated to be longer than a predetermined time.

In the device management system according to the sixth aspect, since the management apparatus executes even the control command that belongs to the single control terminal, execution of the control command can be prevented from taking an extremely long time.

A device management system according to a seventh aspect is the system according to the second aspect, in which (g) the control terminal or/and the management apparatus acquire data of the device or data related to the device as device data. (h) The control terminal or/and the management apparatus that acquire the device data determine whether an event has occurred on the basis of the device data. (b3) If it is determined that the event has occurred in (h), the control terminal or/and the management apparatus execute the control command.

The device management system according to the seventh aspect can execute the control command upon the event that occurs in response to acquisition of the device data.

A device management system according to an eighth aspect is the system according to the seventh aspect, in which (g) the control terminal or/and the management apparatus acquire data of the device or data related to the device as device data. (h) The control terminal or/and the management apparatus that acquire the device data determine whether an event has occurred on the basis of the device data. (d3) If the event has occurred, the control terminal or/and the management apparatus that acquire the device data determine whether the control command is to be executed in the control terminal or the management apparatus. (b4) The control terminal or/and the management apparatus execute the control command that is determined to be executed in (d3).

In the device management system according to the eighth aspect, if the event has occurred, since the control command is executed by being allocated to the management apparatus and the control terminal, the control command can be executed efficiently.

A device management system according to a ninth aspect is the system according to the seventh or eighth aspect, in which (h2) subsequently to the determination of the event in the (h), the control terminal or/and the management apparatus determine whether a secondary event is caused to occur on the basis of the control command that is registered or a program that is defined by the system. (b5) If it is determined that the secondary event has occurred in (h2), the control terminal or/and the management apparatus execute the control command.

The device management system according to the ninth aspect can execute the control command upon occurrence of the secondary event.

A device management system according to a tenth aspect is the system according to any of the seventh to ninth aspects, in which (j) the event that is determined in the control terminal in (g) or the secondary event that is caused to occur in the control terminal in (h2) is transmitted to the management apparatus. (h3) On the basis of the event or the secondary event that is transmitted from the control terminal in (j), the management apparatus determines whether the control command that is registered is to be executed in the management apparatus. (b6) The management apparatus executes the control command that is determined to be executed in (h3).

The device management system according to the tenth aspect can execute the control command in the management apparatus upon occurrence of the event or the secondary event in the control terminal.

A device management system according to an eleventh aspect is the system according to any of the seventh to tenth aspects, in which the management apparatus includes a database. (k) The management apparatus stores, in the database, the event or the secondary event related to the control command that is executed in (b3) to (b6).

In the device management system according to the eleventh aspect, since a history of the event or the secondary event is accumulated in the database, control can be performed so that the secondary event is caused to occur, for example, by using the database.

A device management system according to a twelfth aspect is the system according to any of the first to eleventh aspects, in which both the management apparatus and the control terminal or the control terminals are capable of executing the control command in an identical form.

In the device management system according to the twelfth aspect, since both the management apparatus and the control terminal or the control terminals are capable of executing the control command in the identical form, a user's input in the identical form may suffice.

A device management service providing method according to a thirteenth aspect uses a device management system. The device management system includes a device, a control terminal, and a management apparatus. The control terminal is connected to the device. The management apparatus is connected to the control terminal via a network. Both the control terminal and the management apparatus are configured to be capable of acquiring a control command that is created by a user. (a) The control command that is created by the user is acquired by either one or both of the control terminal and the management apparatus. (b) On the basis of the control command, control of the device is shared and executed in either one or both of the control terminal and the management apparatus.

A device management service providing method according to a fourteenth aspect is the method according to the thirteenth aspect, in which both the management apparatus and the control terminal are capable of executing the control command in an identical form.

In the device management service providing method according to the fourteenth aspect, since both the management apparatus and the control terminal are capable of executing the control command in the identical form, a user's input in the identical form may suffice.

DETAILED DESCRIPTION OF EMBODIMENT(S)

First Embodiment (1) Overall Configuration

Figure 1:
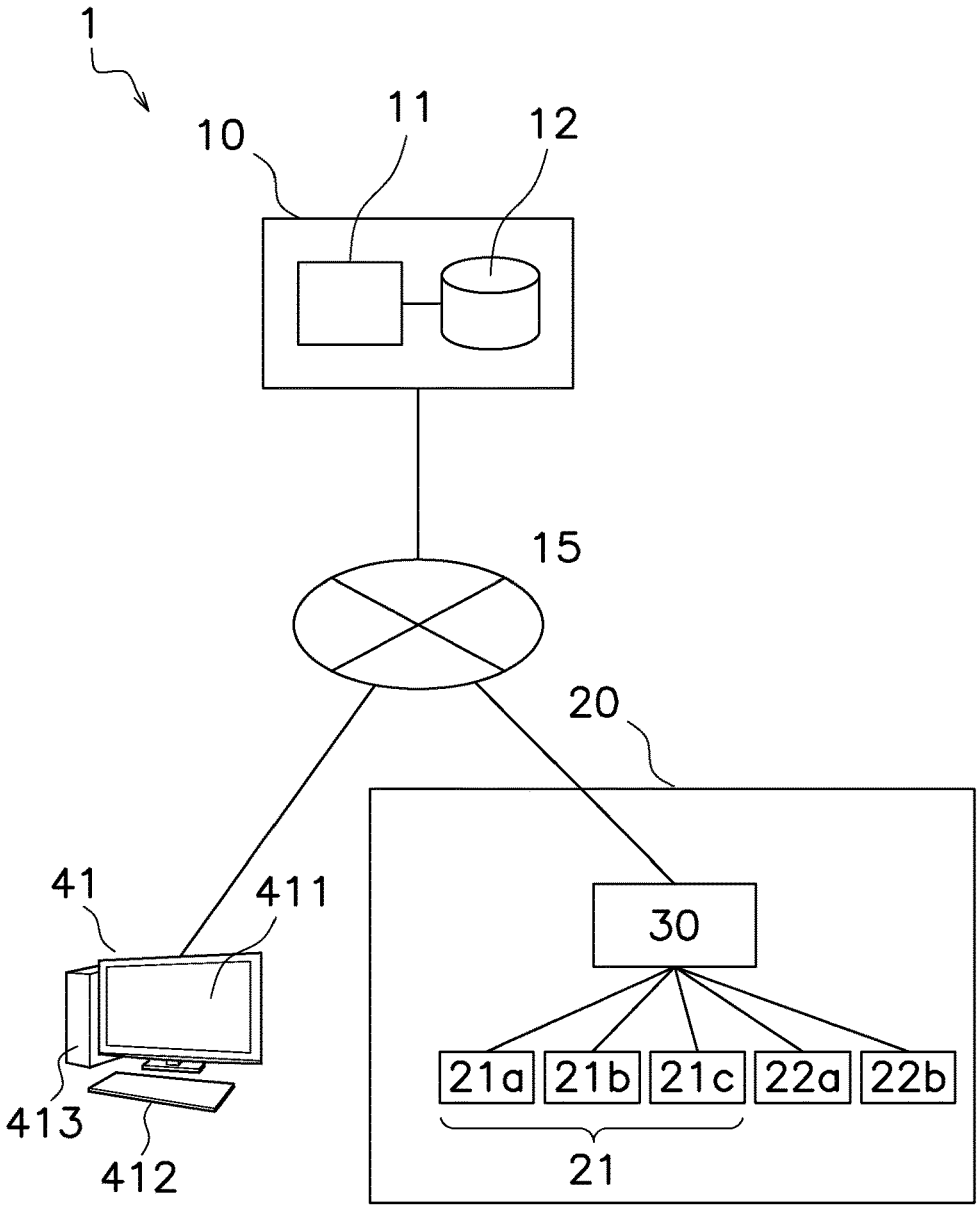
FIG. 1 is a diagram illustrating an overall configuration of a device management system 1.

As illustrated in FIG. 1, a device management system 1 according to this embodiment includes a device 21, a control terminal 30, a management apparatus 10, and a user terminal 41. The device 21 is installed in a building 20. An example of the device 21 is an air conditioner. The control terminal 30 is connected to the device 21. The control terminal 30 may alternatively be built in one of the devices 21. The management apparatus 10 is connected to the control terminal 30 and the user terminal 41 via a network 15. The management apparatus 10 can control the device 21 via the network. The user terminal 41 is an interface for a user and the system 1. The user terminal 41 is connected to the management apparatus 10 via the network 15.

A device management service according to this embodiment provides a service for managing the device 21 by using the device management system 1.

(2) Description of Components of Device Management System 1

(2-1) Device 21

The device 21 is a device that is installed in a building. The building includes not only the inside of the building, but also the rooftop of the building, the surroundings of the building, and the like. The building is not limited to a particular building and may be a commercial building, a residential apartment, a condominium, a public building, a stand-alone house, and the like.

Examples of the device 21 are an air conditioner, a lighting device, a fan, and the like. As the air conditioner, an outdoor unit and a plurality of indoor units connected to the outdoor unit may be treated as a single device, or the outdoor unit and each indoor unit may be regarded as individual devices.

The device 21 in this embodiment is an air-conditioner outdoor unit 21*a* and a plurality of air-conditioner indoor units 21*b* and 21*c*. The air-conditioner outdoor unit 21*a* is connected to the plurality of air-conditioner indoor units 21*b* and 21*c* via refrigerant pipes. The building 20 includes a plurality of rooms (not illustrated). Typically, one or more of the air-conditioner indoor units 21*b* and 21*c* are disposed in each room.

Regarding the device 21, there are various types of device related information, in other words, device data. The device data includes data collected by each device 21 and data collected by others, which are sensors 22*a* and 22*b*. The data collected by each device 21 includes the on/off state of operation, the number of rotations of a compressor, the temperature of a heat exchanger, power consumption, and the like. The sensor includes, for example, the indoor temperature sensor 22*a*, the outdoor temperature sensor 22*b*, and the like. The indoor temperature sensor 22*a* measures the indoor temperature of a room where the air-conditioner indoor unit 21*b* is disposed. The outdoor temperature sensor 22*b* measures the air temperature of outside air that is outside and around the building 20. Among pieces of device related information, the data collected by the sensors 22*a* and 22*b* other than the device 21 includes the indoor temperature, the outdoor temperature, and the like.

The device data is transmitted from each device 21, the sensor 22*a*, or the sensor 22*b* to the control terminal 30. The control terminal 30 transmits the device data to the management apparatus 10 via the network 15.

(2-2) Control Terminal 30

The control terminal 30 is built in the device 21 or disposed outside the device 21. The control terminal 30 is connected to the device 21 and the sensors 22 that collect the device data.

In this embodiment, the control terminal 30 is built in the air-conditioner outdoor unit 21*a*. The outdoor unit 21*a*, the indoor units 21*b* and 21*c*, and the sensors 22*a* and 22*b* are connected to the control terminal 30 with or without wires. With this connection, the device data is transmitted from the device 21 or the sensors 22*a* and 22*b* to the control terminal.

The control terminal executes a control command on an application, as will be described later.

(2-3) User Terminal 41

The user terminal 41 includes a control unit 413, an output unit, and an input unit 412.

The user terminal 41 includes a role of a user interface. The output unit may be a display unit 411. The display unit 411 displays information so that a user can view the information. By user operation, the input unit 412 can input information. The input unit 412 is, for example, a keyboard, a mouse, or a touch panel. The control unit 413 includes a processor and a memory. The control unit 413 controls the display unit 411 and the input unit 412.

The user terminal 41 is connected to the management apparatus 10 via the network 15. The user terminal 41 exchanges information with the management apparatus 10.

The user terminal 41 may be in or out of the building 20 where the device 21 is disposed. In this embodiment, a user of the user terminal 41 is an administrator of the device 21 in the building 20. The user informs, through the user terminal 41, the management apparatus 10 of a request about management of the device 21. The management apparatus 10 notifies, as necessary, the user of information about a management service by using the user terminal 41.

In this embodiment, the control command is a script. The control command is created or input by the user on the user terminal. The control command is transmitted to the management apparatus and executed.

(2-4) Management Apparatus 10

The management apparatus 10 includes a server 11 and a database 12. The management apparatus may be a virtualized management apparatus. The server 11 includes a processor and a memory. The server 11 can execute an application that controls the device 21. The database 12 includes a memory. The database 12 can accumulate and retrieve the device data, the application, an event, which will be described later, and the like.

The management apparatus 10 may be a management apparatus provided by a cloud service provider other than a management service provider in the present disclosure. The cloud service provider may provide an infrastructure alone. The infrastructure includes hardware. The cloud service provider may provide, in addition to the infrastructure, a platform. The platform includes an operating system.

The management apparatus 10 is connected to the control terminal 30 and the user terminal 41 via the network 15. A line via which the management apparatus 10, the control terminal 30, and the user terminal 41 are connected may be a private line or a public line. The private line may be a virtual private network (VPN). The line may be a line that is provided by the cloud service provider.

The server 11 of the management apparatus 10 acquires the device data from the control terminal 30. The server 11 transmits the acquired device data or control command to the database 12. The database 12 accumulates the device related information. The management apparatus calls the device related information accumulated in the database, and determines and executes the device management service.

The server 11 acquires the control command from the user terminal 41. The server 11 can perform control of a device or devices that belong to one or a plurality of control terminals by executing the control command on an application.

(3) Device Control by Device Management System 1

(3-1) Case where Control Command is Registered

Figure 2:
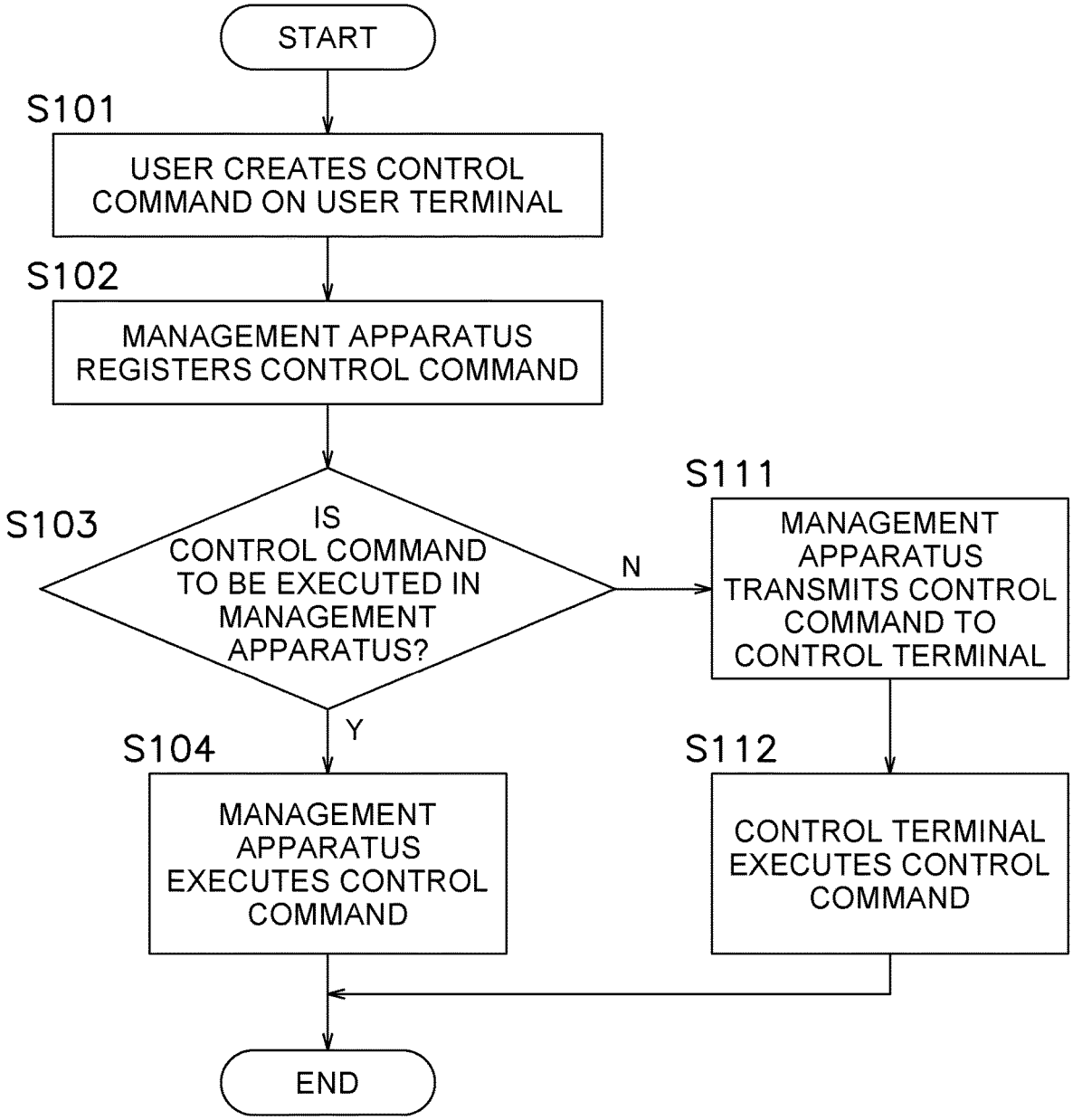
FIG. 2 is a flowchart in which the device management system 1 executes a control command.

Next, device control by the device management system in a case where a control command is registered will be described with reference to FIG. 2.

A user creates a control command (script) on the user terminal 41 (S101). In this embodiment, the user terminal serves simply as a browser, and an application for registering the script is executed in the management apparatus. The input control command is registered in the management apparatus 10 (S102).

Subsequently, the management apparatus 10 determines whether the control command is to be executed in the management apparatus 10 or to be executed in the control terminal (S103). In this embodiment, the control command is determined to be executed in the management apparatus in a case where the control command is to be executed in a plurality of control terminals 30 in cooperation with each other, and is determined to be executed in a control terminal in a case where the control command is to be executed in the single control terminal. The case where the control command is to be executed in a plurality of control terminals 30 in cooperation with each other is, for example, the following case. An owner who owns a plurality of convenience stores wishes to control the overall power consumption amount to be less than a certain amount.

A case where another determination is made in step S103 is a case where execution of control based on the control command in the control terminal is estimated to be longer than a predetermined time.

If the management apparatus 10 determines in step S103 that the control command is to be executed in the management apparatus 10, the management apparatus 10 executes the control command (S104). Note that execution of the control command herein is equivalent to execution of device control on the basis of the control command.

On the other hand, if the management apparatus 10 determines in step S103 that the control command is to be executed in the control terminal, the management apparatus transmits the control command to the control terminal (S111). The control terminal registers the control command and executes the control command (S112).

(3-2) Case where Event Occurs

Next, device control executed in a case where an event occurs will be described with reference to the flowchart in FIG. 3.

First, the control terminal 30 acquires device data from each device 21 and the sensors 22*a* and 22*b* around the device (S201). Note that the device data herein includes data collected by not only the device 21 and the sensors 22*a* and 22*b* but also others. For example, the device data also includes data such as time.

Subsequently, the control terminal 30 transmits the device data to the management apparatus 10 via the network (S202). In the following description, steps in the control terminal 30 and steps in the management apparatus 10 are separately described.

First, the steps in the control terminal 30 will be described. As described in (3-1), it is assumed that several control commands are typically registered and accumulated in the control terminal 30. The processor of the control terminal 30 calls and refers to such a control command from the memory of the control terminal. In this state, the processor of the control terminal 30 determines whether the acquired device data is a trigger for executing the control command (S211). In other words, the processor of the control terminal 30 determines whether an event has occurred. The event herein is an event serving as a trigger for executing automatic control.

Now, the occurrence of the event will be more specifically described. For example, as the device data, data indicating that the device 21 is powered on at the current time 22:10 is acquired. In addition, as the control command, a control command indicating that the device is powered off from 22 o'clock to 5 o'clock is registered. Thus, by collating the above device data against the above control command, the control terminal 30 determines that the event has occurred (S211).

If the event has occurred in step S211, automatic control is executed in step S212. In the above example, the control terminal 30 powers off the device 21.

If no event has occurred in step S211, the control terminal 30 ends the processing.

Next, a case where the management apparatus executes control after the device data is transmitted to the management apparatus in step S202 will be described.

The management apparatus 10 checks a control command that is registered in the management apparatus 10 and that is to be executed in the management apparatus. Thus, the management apparatus 10 checks whether the event serving as a trigger of the control command to be executed in the management apparatus has occurred (S203).

If the event has occurred in step S203, the management apparatus executes automatic control in step S204. If no event has occurred in step S203, the management apparatus ends the processing.

Note that both the control terminal 30 and the management apparatus 10 acquire the device data in this embodiment. The control command is registered to be executed in either the control terminal 30 or the management apparatus 10 depending on details. Thus, whether the management apparatus or the control terminal executes the event is determined depending on which the control command is registered in. Note that the same applies to a secondary event described below.

(3-3) Case where Secondary Event Occurs

Next, a secondary event will be described.

The secondary event is an event that occurs as a result of certain calculation processing using a device state value. In contrast, the event described in (3-2) is an event that can be detected when the device state value changes. Such an event herein may be referred to as a primary event to be distinguished from the secondary event.

Next, a case will be described in which, in control commands registered in the system 1, both a control command related to the primary event and a control command related to the secondary event are present.

Figure 4:
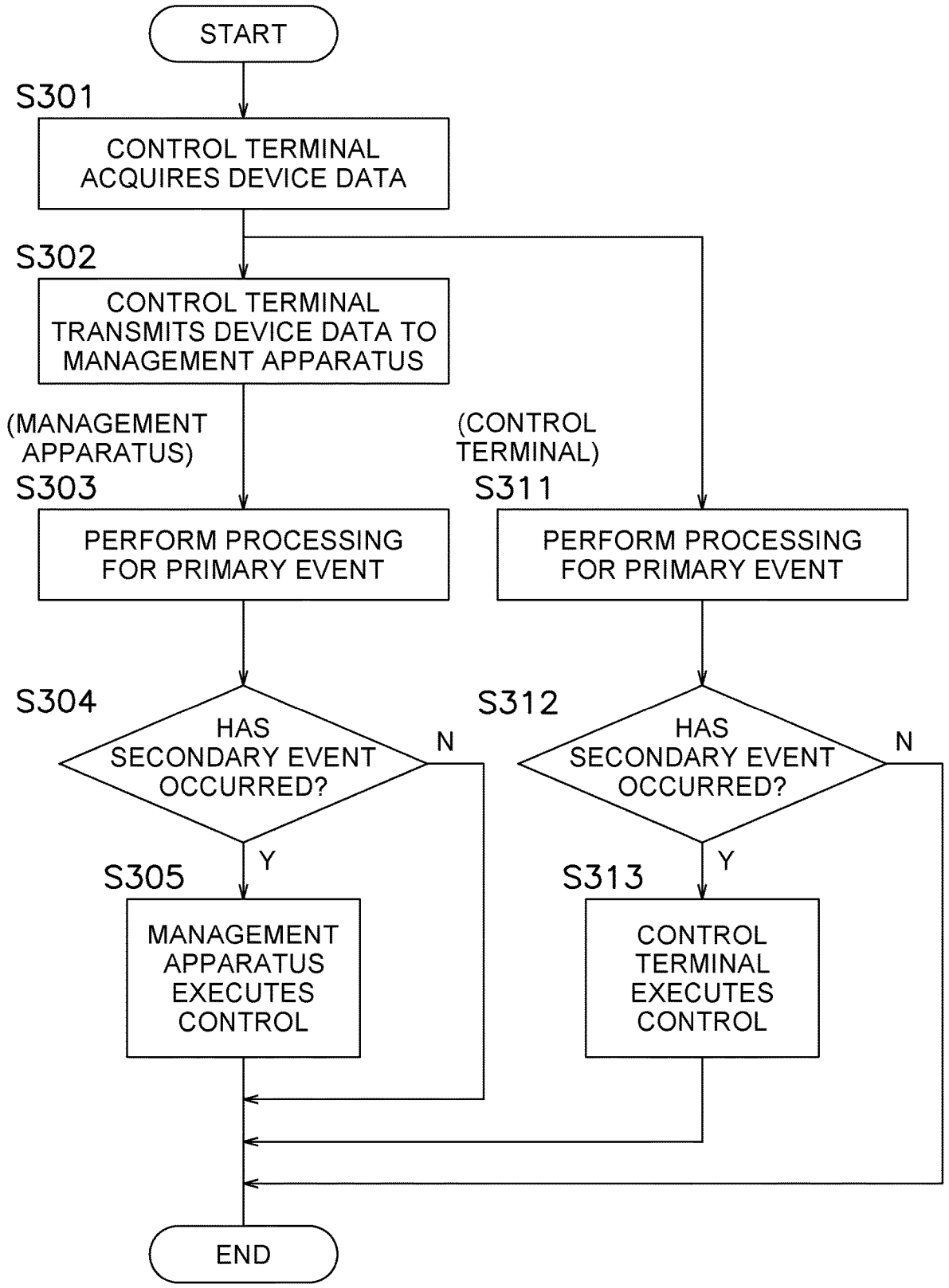
FIG. 4 is a flowchart illustrating the manner of execution of automatic control by the device management apparatus in a case where a secondary event occurs.

FIG. 4 illustrates a flow of device control in the device management system 1 in a case where the secondary event is present.

First, the control terminal 30 acquires device data from each device 21 and the sensors 22*a* and 22*b* around the device (S301). Subsequently, the control terminal 30 transmits the device data to the management apparatus 10 via the network (S302). In the following description, steps in the control terminal 30 and steps in the management apparatus 10 are separately described.

First, steps in the control terminal 30 will be described. The processor of the control terminal 30 performs processing for calling a control command related to the primary event from the memory of the control terminal (S311). This processing is completely the same as that in the case of (3-2). Subsequently, the control terminal 30 transitions to processing of a control command related to the secondary event (S312).

Now, examples of the processing based on a control command of the secondary event will be described. For example, the device data is an indoor temperature. In addition, details of the control command are such that a cooling operation automatically starts when the indoor temperature exceeds 28° C., which is a threshold. In such a case, for example, the control terminal acquires an indoor temperature of 30° C. as the device data in step S301. Subsequently, the control terminal 30 performs processing for the primary event in step S311, and then transitions to processing for the secondary event in S312. In this step, the control terminal compares an actual indoor temperature and an indoor temperature that is a processing condition of the control command with each other. In this case, the indoor temperature being 30° C. according to the data exceeds the processing condition, which is the indoor temperature being 28° C., and thus, an air conditioner (device) is controlled to perform a cooling operation (S313). In other words, the control terminal 30 executes automatic control.

Next, processing in the management apparatus at and after step S302 will be described. Following S302, the management apparatus 10 performs processing for the primary event (S303). This processing is completely the same as the processing in (3-2).

Subsequently, in step S304, the management apparatus 10 determines whether the secondary event has occurred. If the secondary event has occurred, the management apparatus executes automatic control in S305. If no secondary event has occurred in S304, the management apparatus ends the processing.

Note that the primary event and the secondary event are all stored in the database 12 of the management apparatus 10 in the same manner as the control command. The storage may be the memory of the server 11 or the memory of the control terminal 30. The primary event and the secondary event may be stored in both the management apparatus 10 and the control terminal 30. In some cases, the primary event and the secondary event may be used for the next determination as to whether a secondary event has occurred.

(3-4) Case where Control Terminal 30 Takes Extremely Long Time to Execute Control Command Now, referring back to step S112 in FIG. 2, a flow in a case where the control terminal 30 takes an extremely long time to execute the control command will be described with reference to FIG. 5.

Figure 5:
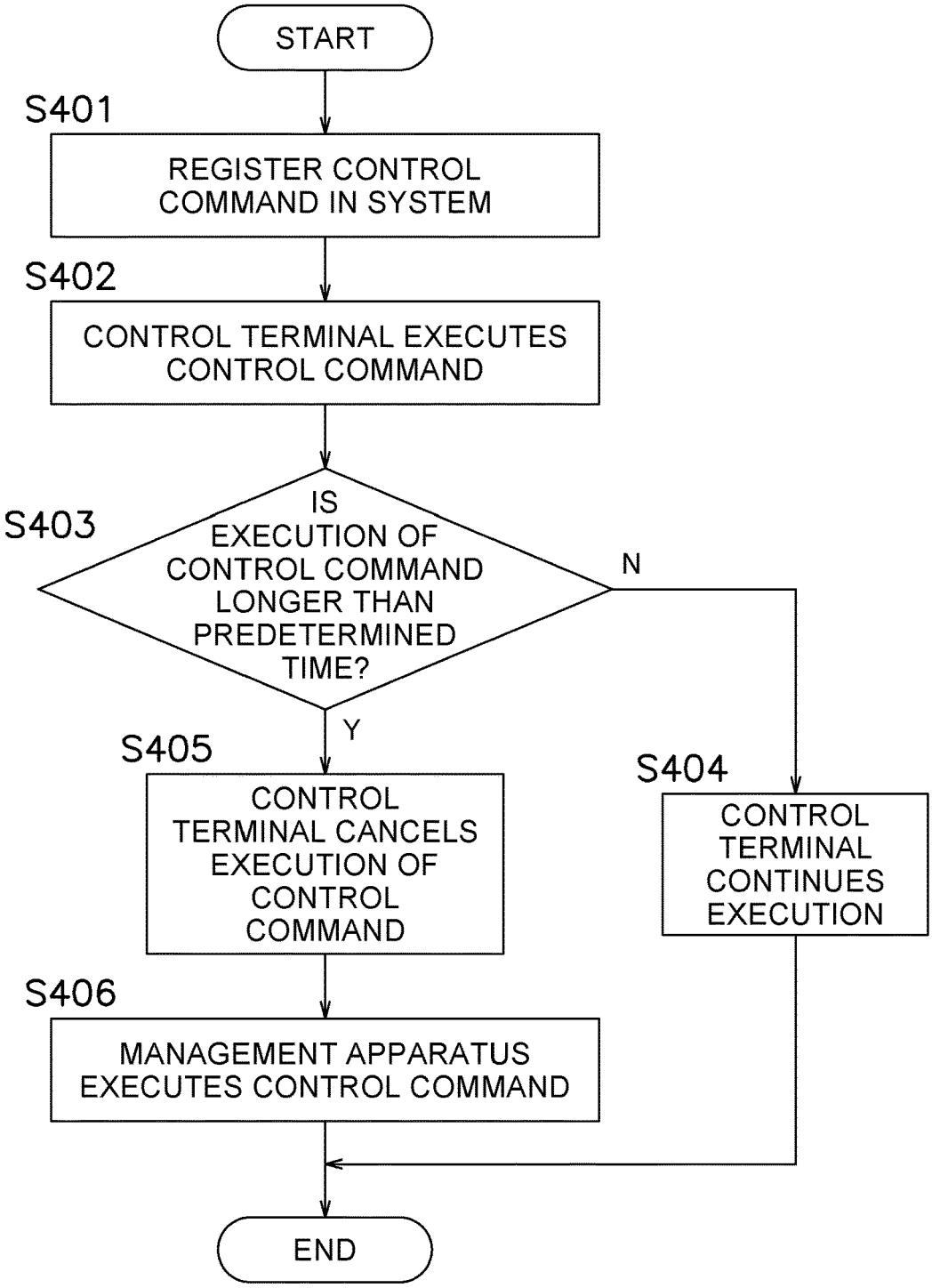
FIG. 5 is a flowchart illustrating processing performed in a case where a control terminal requires a time longer than or equal to a predetermined time for executing a control command.

In FIG. 5, first, the processing returns to where a user registers a control command (S401). Subsequently, in a case of S103, S111, and S112 in FIG. 2, the management apparatus 10 determines that the control command is to be executed in the control terminal, and the control terminal 30 executes the control command (S402).

During execution of the control command, the control terminal 30 may take an extremely long time. For example, in a case where the management apparatus 10 estimates a time during which the control terminal 30 executes the control command by using data before the device 21 to be controlled by the single control terminal 30 increases, the control terminal 30 may execute the control command by taking a time more than or equal to the estimation at the time of determination by the management apparatus.

To cope with such an issue, the system 1 sets an upper limit of a processing time of the control terminal. In FIG. 5, if the control command processing time of the control terminal 30 exceeds a predetermined time, the control terminal cancels execution of the control command (S405). Subsequently, the management apparatus 10 with higher processing performance executes the control command (S406).

In step S403, it is determined whether the time during which the control terminal executes the control command is longer than the predetermined time. The determination may be made after the time actually exceeds the predetermined time or may be made on the basis of the estimation before the time exceeds the predetermined time.

If execution of the control command ends within the predetermined time in step S403, the control terminal continues execution of the control command until the end.

Figure 6:
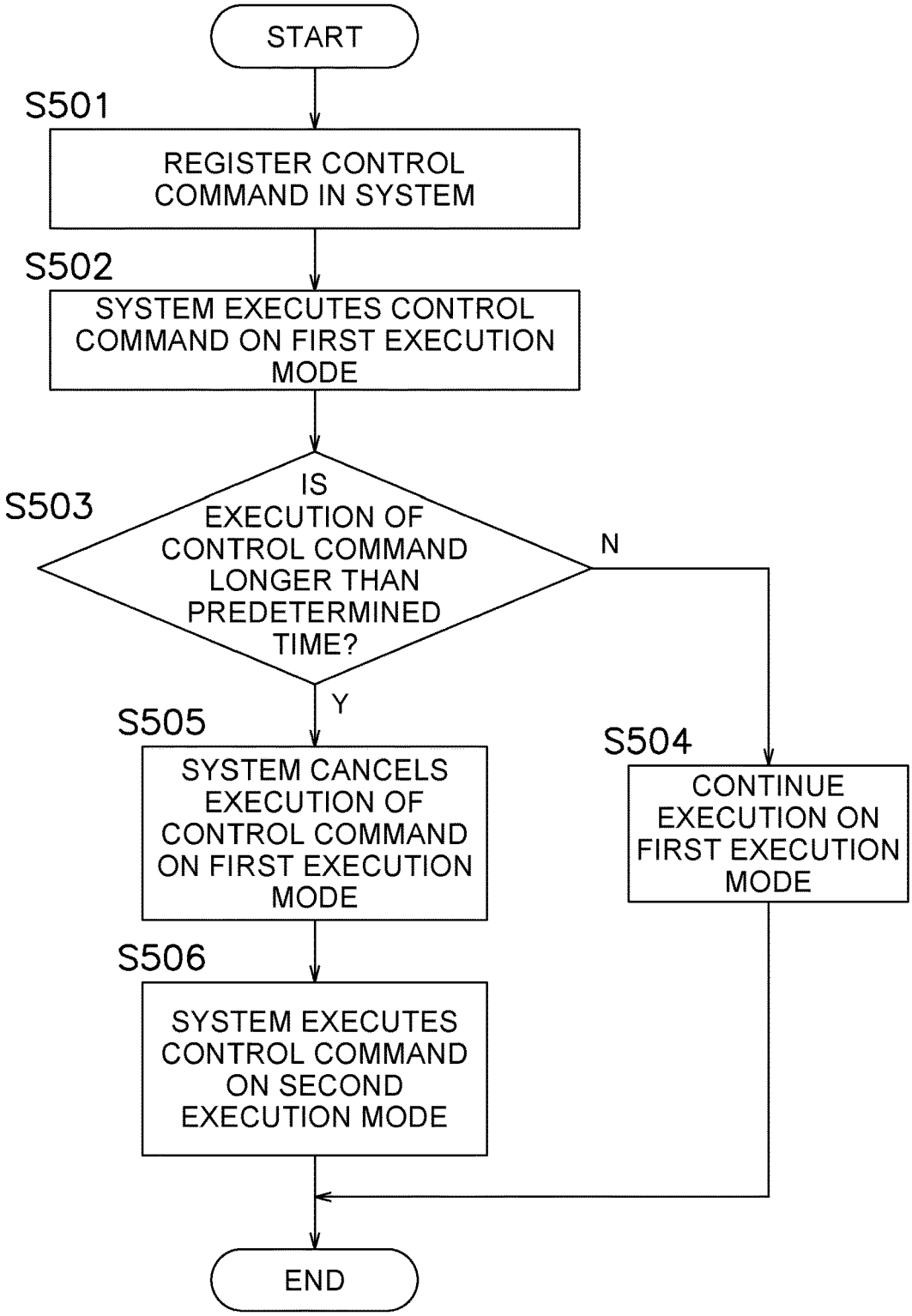
FIG. 6 is a flowchart illustrating processing performed in a case where the system 1 requires a time longer than or equal to the predetermined time for executing processing on a first execution mode.

The control flow in FIG. 5 can be generalized as illustrated in FIG. 6. To describe this, a plurality of execution modes can be considered for executing a control command in the whole system 1. An execution mode with lower processing performance is referred to as a first execution mode, and an execution mode with higher processing performance than the first execution mode is referred to as a second execution mode. The use of the first execution mode is not completely disadvantageous, and, for example, there may be advantages such as a small charge. In the case of FIG. 5, execution of a control command in the control terminal can be regarded as the first execution mode, and execution of a control command in the management apparatus can be regarded as the second execution mode. Thus, the control flow in FIG. 5 can be rewritten as the control flow in FIG. 6. In other words, in step S503, during execution of the automatic control flow on the first execution mode, if the execution time exceeds or is about to exceed the predetermined time, the system cancels execution on the first execution mode (S505), and performs execution on the second execution mode (S506).

(4) Characteristics (4-1)

The device management system 1 according to this embodiment includes the device 21, the control terminal 30, and the management apparatus 10. The device 21 is disposed in the building 20. The control terminal 30 is connected to the device 21. The management apparatus 10 is connected to the control terminal 30 via the network 15. The device management system 1 performs automatic control of the device 21 by using the network.

A user creates a control command (S101). The management apparatus 10 acquires the control command created by the user. The control command acquired by the management apparatus 10 is transmitted to the control terminal 30 (S111). The control terminal 30 acquires the control command.

The management apparatus 10 or the control terminal 30 executes the control command (S104, S112). The user can input the control command to be executed in the management apparatus 10 and the control command to be executed in the control terminal 30 in a common form. In other words, both the control commands are described in a common script. The management apparatus 10 and the control terminal 30 can execute the control commands created in the common script.

Thus, the user does not have to input the control command to be executed in the management apparatus and the control command to be executed in the control terminal in different forms, and thereby, the input load is reduced.

(4-2)

In this embodiment, the control command input to the management apparatus 10 is registered in the management apparatus 10 (S102). The control command registered in the management apparatus is executed in the management apparatus or the control terminal (S104, S112).

The control command registered in the management apparatus is further stored in the management apparatus.

The control command registered in and recorded on the management apparatus can be executed, needless to say when the control command is registered, and also when an event occurs, for example, after a time elapses.

The control command may also be registered in the control terminal. The registered control command may also be recorded on the control terminal.

Since the control command is registered in both the management apparatus and the control terminal, the system can select the management apparatus or the control terminal to perform execution depending on details of the control command. In addition, even if communication between the management apparatus and the control terminal is disconnected, the control terminal can execute the control command.

(4-3)

In this embodiment, the control command is registered in the management apparatus (S102). The management apparatus determines whether the control command is to be executed in the management apparatus or to be executed in the control terminal and allocates the control command (S103).

The determination by the management apparatus can make appropriate allocation.

(4-4)

In this embodiment, the criterion for the management apparatus to allocate the control command to the management apparatus or the control terminal (S103) in (4-3) is whether the control command is to be executed in a plurality of control terminals in cooperation with each other or to be executed in a single control terminal.

By using such a criterion, the control terminal generates the advantage of being capable of controlling a single device when the control is only for the device that belongs to the control terminal. In addition, the data traffic (=communication cost) between the management apparatus and the control terminal for execution of the control command can be reduced.

(4-5)

The device management system 1 according to this embodiment records the control command on a memory. When the control terminal 30 acquires the device data (S201), the system 1 determines whether the event has occurred (S203, S211), and, if it is determined that the event has occurred, executes automatic control (S204, S212).

Since the device management system 1 according to this embodiment registers and records the control command in and on the system in the above manner, a broadly standardized system can be easily established.

(4-6)

The device management system according to this embodiment can use the device state value and can also use the secondary event that occurs as a result of certain calculation processing.

The use of the secondary event enables execution of more complex automatic control than the primary event.

(4-7)

In the device management system according to this embodiment, while the control terminal 30 is executing device control (S402) on the basis of the control command, if the control execution time is longer than the predetermined time (S403), the control terminal 30 cancels execution of device control based on the control command (S405), and the management apparatus 10 executes control of the device 21 based on the control command.

This avoids a situation where the system 1 is incapable of executing the control command owing to timeout. In addition, processing is basically executed in the control terminal 30 with low cost, and the processing is transferred to the management apparatus 10 with high cost as necessary, and thus, the cost as a whole can be suppressed.

(5) Modifications (5-1) Modification 1A

In FIG. 5 in the first embodiment, control is described in which, the control command is registered in the system (S401), and, while the control terminal 30 is executing the control command (S402), if the execution time exceeds the predetermined time (S403), the control terminal temporarily cancels the execution (S405).

A modification 1A is a case where the control terminal 30 acquires the device data and starts to execute the control command upon occurrence of an event. Also in this case, if the execution by the control terminal takes an extremely long time (S403), as in the case in FIG. 5, the control terminal may cancel execution of the control command (S405). Subsequently, the management apparatus 10 may execute the control command.

The above can be implemented in either case where the event is a primary event or a secondary event.

(5-2) Modification 1B

In the first embodiment, after acquiring the device data, the control terminal 30 transfers the device data to the management apparatus. In a modification 1B, this is not always necessary.

Figure 3:
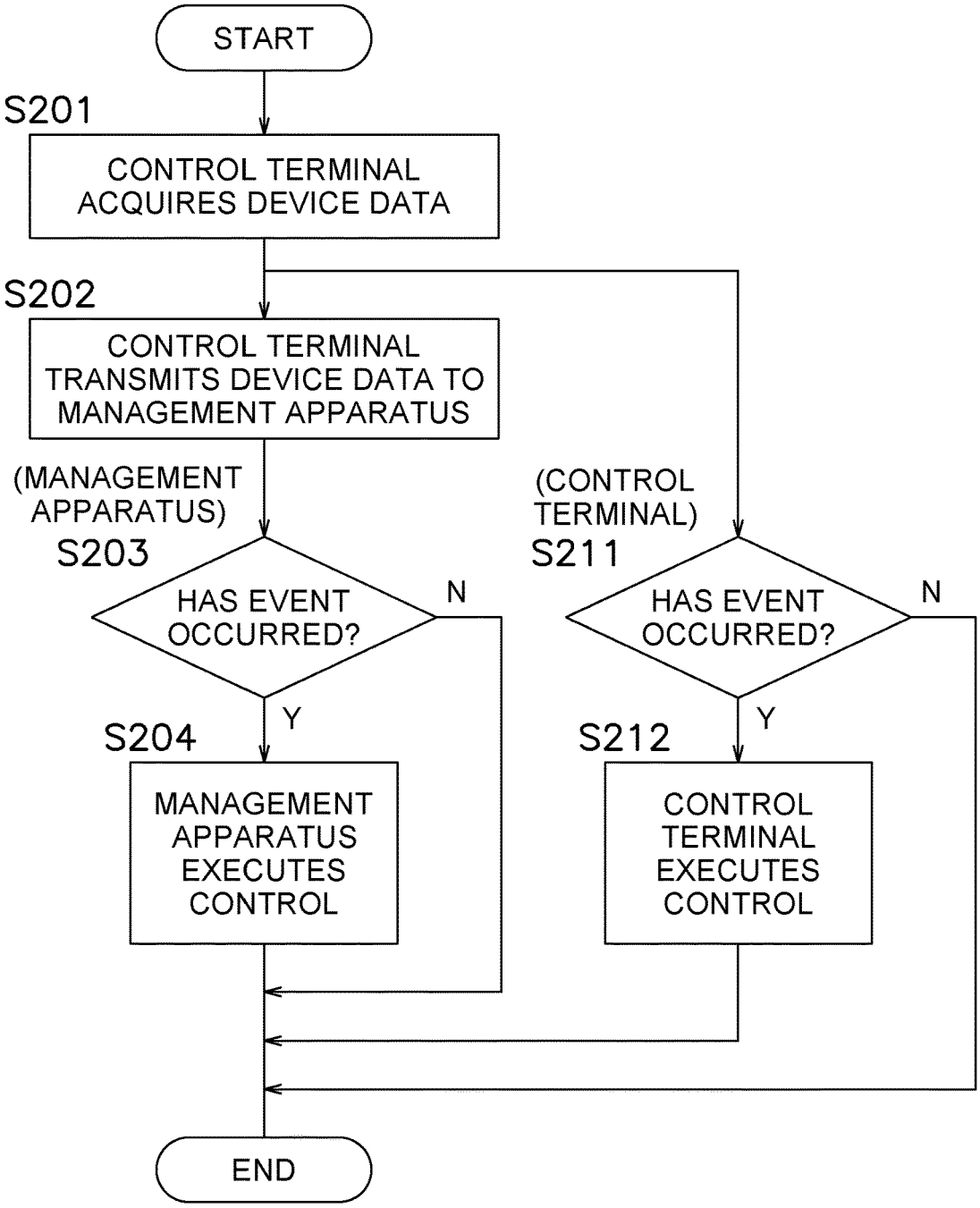
FIG. 3 is a flowchart illustrating the manner of execution of automatic control by a device management apparatus in a case where an event occurs.

In the modification 1B, after checking whether the event has occurred in step S211 in FIG. 3, the control terminal 30 determines whether the control command is to be executed in the control terminal 30 or to be executed in the management apparatus 10. If it is determined that the control command is to be executed in the control terminal 30, as in FIG. 3 in the first embodiment, the control terminal executes the control command (S212). If the control terminal 30 determines that the control command is to be executed in the management apparatus 10, the control terminal 30 transmits the control command to the management apparatus 10, and the management apparatus 10 executes the control command.

The above can be implemented in either case where the event is a primary event or a secondary event.

(5-3) Modification 1C

In the first embodiment, after acquiring the device data, the control terminal 30 transfers the device data to the management apparatus. In a modification 1C, as in the modification 1B, this is not always necessary.

In the modification 1C, after checking whether the event has occurred in step S211 in FIG. 3, the control terminal 30 transmits the event to the management apparatus. The management apparatus determines whether the control command is to be executed in the management apparatus 10. If it is determined that the control command is to be executed in the management apparatus 10, the management apparatus 10 executes the control command.

The above can be implemented in either case where the event is a primary event or a secondary event.

(5-4) Modification 1D

In the modifications 1B and 1C, an event is caused to occur in the control terminal 30. Alternatively, an event may be caused to occur in the management apparatus 10.

In a modification 1D, the control terminal 30 transmits the device data to the management apparatus in step S202 in FIG. 3. In step S203, it is checked whether the event has occurred in the management apparatus 10. After the event has occurred in step S203, the modification 1D differs from the first embodiment. The management apparatus determines whether the control command is to be executed in the management apparatus or to be executed in the control terminal. If it is determined that the control command is to be executed in the management apparatus 10, as in FIG. 3 in the first embodiment, the management apparatus executes the control command (S204). If the management apparatus 10 determines that the control command is to be executed in the control terminal 30, the management apparatus 10 transmits the event (and the control command as necessary) to the control terminal 30, and the control terminal 30 executes the control command.

The above can be implemented in either case where the event is a primary event or a secondary event.

Although the embodiment of the present disclosure has been described above, it should be understood that various changes can be made on the form or details without departing from the spirit and scope of the present disclosure described in the scope of claims.

What is claimed is:

1. A device management system comprising:

at least one device installed in a building;

at least one control terminal connected to the device; and a management apparatus connected to the control terminal via a network, both the control terminal and the management apparatus being configured to be capable of acquiring a control command that is created by a user, the control command that is created by the user being acquired by at least one of the control terminal and the management apparatus and registered by the control terminal and the management apparatus, and based on the control command that is acquired, control of the device being shared and executed in at least one of the control terminal and the management apparatus, wherein the management apparatus determines whether the control command that is acquired is to be executed in the management apparatus or to be executed in the control terminal, the control command is executed in the management apparatus if it is determined that the control command is to be executed in the management apparatus, the control command is transmitted to the control terminal if it is determined that the control command is to be executed in the control terminal, and the control terminal executes the control command that is transmitted from the management apparatus.

2. The device management system according to claim 1, wherein the at least one device includes a plurality of devices installed in a building; and the at least one device includes a plurality of control terminals, each control terminal being connected to a corresponding one of the plurality of devices, if it is determined that a device that is a target of the control command belongs to a single control terminal of the plurality of control terminals, the management apparatus determines that the control command is to be executed in the control terminal, and if it is determined that the devices that are targets of the control command belong to the plurality of control terminals, the management apparatus determines that the control command is to be executed in the management apparatus.

3. The device management system according to claim 2, wherein even if it is determined that the device that is a target of the control command belongs to a single control terminal of the plurality of control terminals, the management apparatus determines that control based on the control command is to be executed in the management apparatus if execution of the control based on the control command in the control terminal is estimated to be longer than a predetermined time.

4. The device management system according to claim 1, wherein, while the control terminal is executing control of the device based on the control command, if an execution time of the control is longer than a predetermined time, the control terminal cancels execution of the control of the device based on the control command, and the management apparatus executes the control of the device based on the control command.

5. The device management system according to claim 1, wherein at least one of the control terminal and the management apparatus acquire data of the device or data related to the device as device data, at least one of the control terminal and the management apparatus that acquire the device data determine whether an event has occurred based on the device data, and if it is determined that the event has occurred, at least one of the control terminal and the management apparatus execute the control command.

6. The device management system according to claim 5, wherein at least one of the control terminal and the management apparatus acquire data of the device or data related to the device as device data, at least one of the control terminal and the management apparatus that acquire the device data determine whether an event has occurred based on the device data, if the event has occurred, at least one of the control terminal and the management apparatus that acquire the device data determine whether the control command is to be executed in the control terminal or the management apparatus, and at least one of the control terminal and the management apparatus execute the control command that is determined to be executed.

7. The device management system according to claim 6, wherein subsequently to the determination of whether the event has occurred, at least one of the control terminal and the management apparatus determine whether at least one of the control terminal and the management apparatus cause a secondary event to occur based on the control command that is registered or a program that is defined by the system, and if it is determined that the secondary event has occurred, at least one of the control terminal and the management apparatus execute the control command.

8. The device management system according to claim 6, wherein the event that is determined in the control terminal or the secondary event that is caused to occur in the control terminal is transmitted to the management apparatus, based on the event or the secondary event that is transmitted from the control terminal, the management apparatus determines whether the control command that is registered is to be executed in the management apparatus, and the management apparatus executes the control command that is determined to be executed.

9. The device management system according to claim 6, wherein the management apparatus includes a database, and the management apparatus stores, in the database, the event or the secondary event related to the control command that is executed.

10. The device management system according to claim 5, wherein subsequently to the determination of whether the event has occurred, at least one of the control terminal and the management apparatus determine whether at least one of the control terminal and the management apparatus cause a secondary event to occur based on the control command that is registered or a program that is defined by the system, and if it is determined that the secondary event has occurred, at least one of the control terminal and the management apparatus execute the control command.

11. The device management system according to claim 10, wherein the event that is determined in the control terminal or the secondary event that is caused to occur in the control terminal is transmitted to the management apparatus, based on the event or the secondary event that is transmitted from the control terminal, the management apparatus determines whether the control command that is registered is to be executed in the management apparatus, and the management apparatus executes the control command that is determined to be executed.

12. The device management system according to claim 10, wherein the management apparatus includes a database, and the management apparatus stores, in the database, the event or the secondary event related to the control command that is executed.

13. The device management system according to claim 5, wherein the event that is determined in the control terminal or the secondary event that is caused to occur in the control terminal is transmitted to the management apparatus, based on the event or the secondary event that is transmitted from the control terminal, the management apparatus determines whether the control command that is registered is to be executed in the management apparatus, and the management apparatus executes the control command that is determined to be executed.

14. The device management system according to claim 13, wherein the management apparatus includes a database, and the management apparatus stores, in the database, the event or the secondary event related to the control command that is executed.

15. The device management system according claim 5, wherein the management apparatus includes a database, and the management apparatus stores, in the database, the event or the secondary event related to the control command that is executed.

16. The device management system according to claim 1, wherein both the management apparatus and the control terminal are capable of executing the control command in an identical form.

17. A device management service providing method for a user of a device that is installed in a building, the device management service providing method comprising:

using a device management system including the device, a control terminal connected to the device, and a management apparatus connected to the control terminal via a network, both the control terminal and the management apparatus being configured to be capable of acquiring a control command that is created by the user, the control command that is created by the user being acquired by at least one of the control terminal and the management apparatus and registered by the control terminal and the management apparatus, and based on the control command, control of the device is shared and executed in a least one of the control terminal and the management apparatus, wherein the management apparatus determines whether the control command that is acquired is to be executed in the management apparatus or to be executed in the control terminal, the control command is executed in the management apparatus if it is determined that the control command is to be executed in the management apparatus, the control command is transmitted to the control terminal if it is determined that the control command is to be executed in the control terminal, and the control terminal executes the control command that is transmitted from the management apparatus.

18. The device management service providing method according to claim 17, wherein both the management apparatus and the control terminal are capable of executing the control command in an identical form.

* * * * *